United States Patent [19]

Thompson

[11] Patent Number: 4,630,708

[45] Date of Patent: Dec. 23, 1986

[54] SEMI-ADJUSTABLE SERVICE PLATFORM APPARATUS FOR GANTRY CRANE

[76] Inventor: George J. Thompson, 134 Watersedge, Ocean Springs, Miss. 39564

[21] Appl. No.: 823,565

[22] Filed: Jan. 29, 1986

[51] Int. Cl.[4] ..... E04G 3/10; E04G 3/16

[52] U.S. Cl. ..... 182/12; 182/36; 182/131; 182/142

[58] Field of Search ..... 182/150, 142, 131, 63, 182/62.5, 223, 12, 13, 148, 36

[56] References Cited

U.S. PATENT DOCUMENTS

| | | | |
|---|---|---|---|
| 2,067,344 | 1/1937 | Ringe | 182/131 |
| 3,076,522 | 2/1963 | Goodell | 182/150 |
| 3,927,732 | 12/1975 | Ooka | 182/62.5 |
| 4,103,861 | 8/1978 | Buchler | 182/150 |
| 4,154,318 | 5/1979 | Malleone | 182/62.5 |
| 4,546,852 | 10/1985 | Martin et al. | 182/12 |

*Primary Examiner*—Reinaldo P. Machado
*Attorney, Agent, or Firm*—Bruce & McCoy

[57] ABSTRACT

An adjustable service platform apparatus for a gantry crane having an elongated base frame which includes a pair of horizontally sliding beams which are laterally extendible outboard in opposite directions from the base frame. Detachable towers with work platforms at the tops are secured to the ends of the sliding beams. The platforms can be raised and lowered and moved inboard and outboard along the crane by the hoist and trolley motions of the crane and can be laterally extended and retracted independently from the hoist and trolley motions of the crane. Operators standing on the work platforms can readily move them to provide access to and permit inspection of the structural elements of the crane's supporting structure from the top of the boom to part way down the base structure of the crane by means of work platform controls.

2 Claims, 6 Drawing Figures

SEMI-ADJUSTABLE SERVICE PLATFORM APPARATUS FOR GANTRY CRANE

CROSS-REFERENCES TO RELATED APPLICATIONS

The present invention is a simplified version of the Adjustable Service Platform Apparatus for a Gantry Crane disclosed in U.S. Pat. No. 4,546,852 issued Oct. 15, 1985, to inventors John F. Martin and Charles H. Zwiefel and assigned to Fruehauf Corporation of Gulfport, Miss.

BACKGROUND OF THE INVENTION

1. Field of the Invention

The present invention relates to apparatus for servicing gantry type cranes. More particularly it relates to an apparatus which can be picked up by the lifting head block of the crane and moved to various positions under the crane gantry to provide access to the structure of the crane by inspectors and repairmen.

2. Background of the Invention

The specific description of the background of the invention is set forth in detail in the above-referenced prior art U.S. Pat. No. 4,546,852.

SUMMARY OF THE INVENTION

The present invention is a simplified version of the Adjustable Service Platform Apparatus of U.S. Pat. No. 4,546,852. The improvement includes a base frame adapted to be lifted by the hoist ropes of an overhead trolley of a gantry crane and moved inboard and outboard along the crane's gantry. The base frame includes a lift beam which can be secured to a quick change head block of the trolley which is the moveable hoist platform of the gantry crane hoisting machinery. Instead of a pair of work platforms as shown in U.S. Pat. No. 4,546,852, which include a multiplicity of horizontal retractable extensions with means for independently moving the work platforms laterally inboard and outboard along the base frame, the present invention includes a pair of horizontally sliding beams which are independently extendible laterally outboard in opposite directions from the base frame. Instead of means for independently raising and lowering the work platforms relative the base frame as shown in U.S. Pat. No. 4,546,852, the present invention utilizes a pair of detachable towers which are secured to the ends of the sliding beams and include work platforms disposed at the tops of the towers. These platforms are raised and lowered with respect to the structure of the gantry crane by the hoist apparatus of the crane rather than by independent raising and lowering means. These towers can be detached from the sliding beams and nested on top of the base frame whereby the base frame with the towers secured thereon in nested relation can be placed inside a standard cargo container along with the work platforms.

OBJECTS OF THE INVENTION

It is therefore an important object of the present invention to provide an improved and simplified adjustable service platform apparatus for a gantry crane.

It is another object of the present invention to provide a service platform apparatus for a gantry crane in which the work platform is moved up and down with respect to the crane structure by means of the crane hoisting apparatus.

It is a further object of the present invention to provide a service platform apparatus for a gantry crane which is much less expensive to construct than the known prior art apparatus; and It is still another object of the present invention to provide a semi-collapsible service platform apparatus for a gantry crane which can be contracted and partially disassembled and stored in a standard cargo container.

DETAILED DESCRIPTION OF THE PREFERRED EMBODIMENT

The apparatus of the present invention is typically used for servicing a dock side gantry crane. Obviously it can be utilized to service any large crane. A typical dock side crane is illustrated in the referenced prior art U.S. Pat. No. 4,546,852. It has an A-frame supporting structure which travels along a dock parallel to the water way on dock side rails. A gantry boom is hinged to the supporting A-frame structure and retractably extends over the water way. A load carrying gantry extends through the A-frame structure fore and aft of the A-frame onto the boom such that the gantry has an outreach portion for loading and unloading over a docked ship. The backreach portion allows for loading and unloading over the dock storage area. A moveable trolley is mounted on gantry rails, and wire rope reeving or load-lifting ropes depend from the trolley and are actuated by conventional crane-mounted hoist machinery. The wire rope reeving permits the trolley to lift and transport the load along a gantry under the control of a crane operator. A more detailed description of this operation is also included in U.S. Pat. No. 4,546,852.

Figure 2:
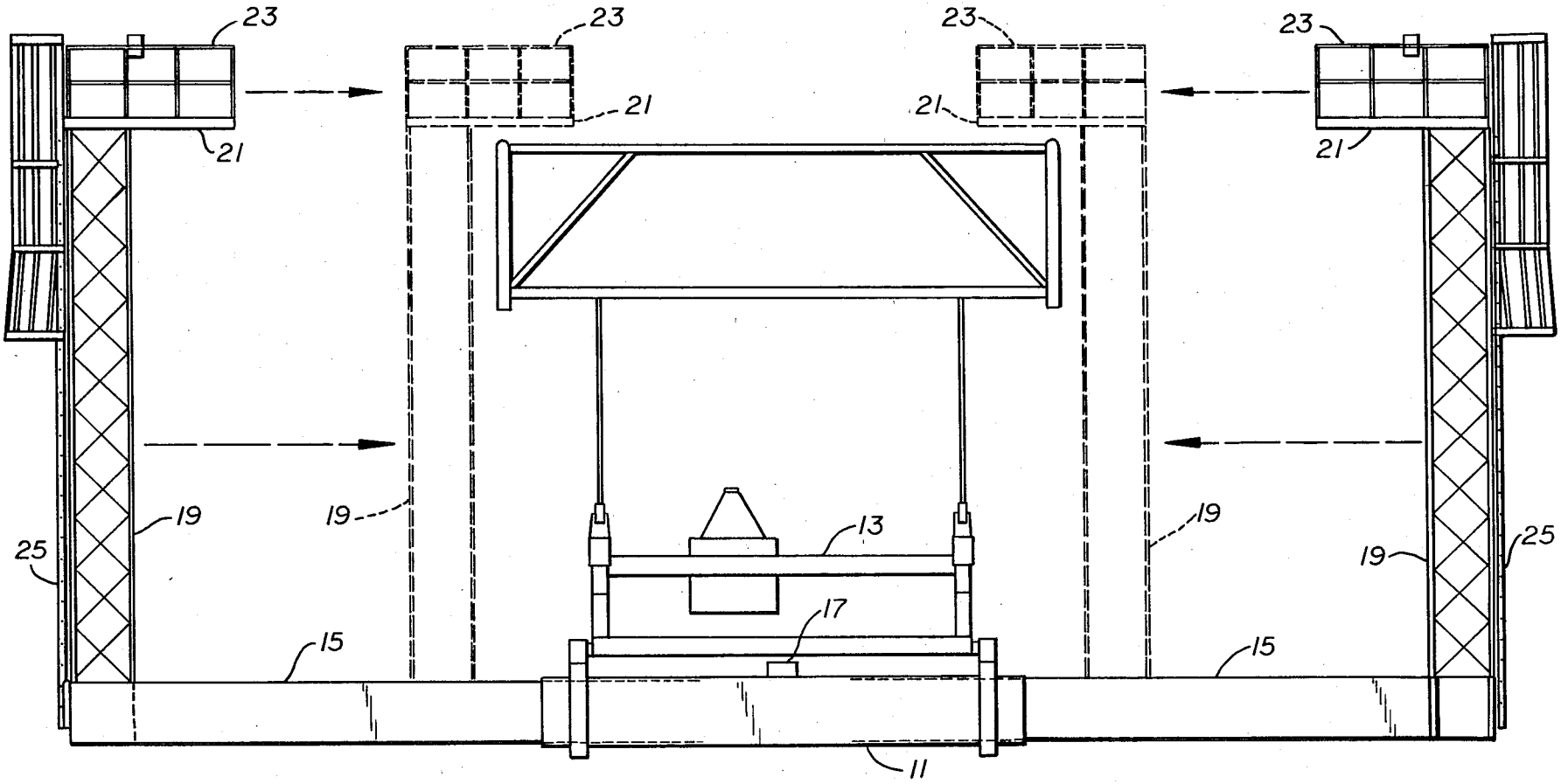
FIG. 2 is a front elevation thereof.
Figure 3:
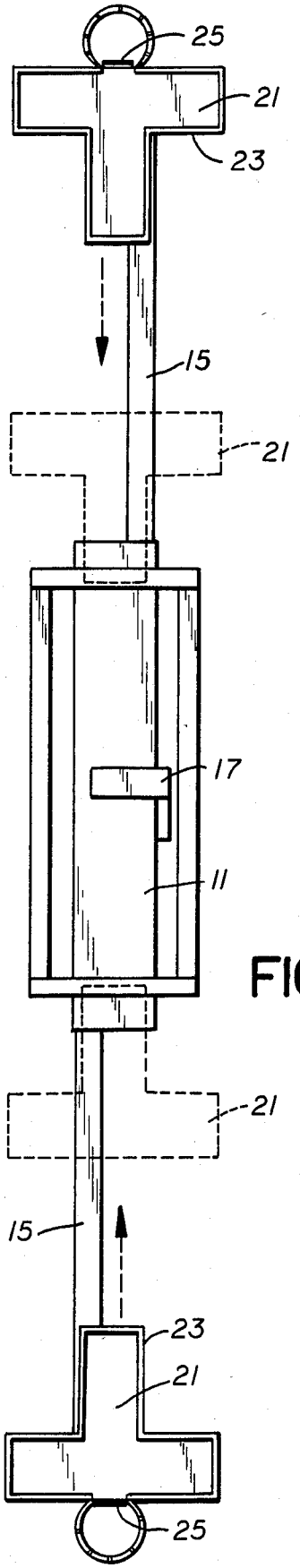
FIG. 3 is a top plan view thereof.
Figure 4:
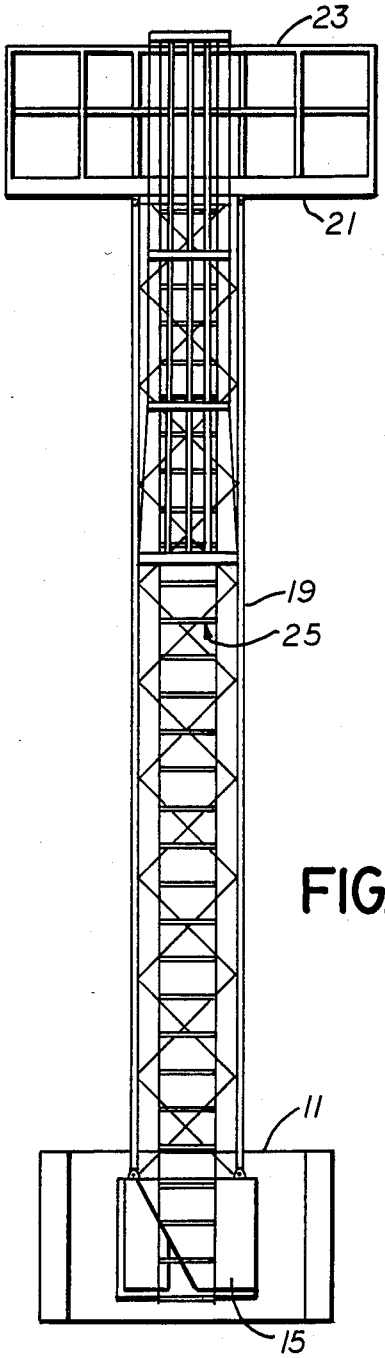
FIG. 4 is an end elevation thereof.

A preferred embodiment of the semi-adjustable service apparatus of the present invention fully assembled for operation is shown in FIGS. 2, 3 and 4. The service platform apparatus has a base frame 11 adapted to be releasably secured to the quick-change head block 13 shown in FIG. 2 which is suspended from the crane trolley by the wire rope reeving (not shown). The base frame includes a pair of horizontally sliding beams 15 which are extendible in opposite directions outboard from the base frame either independently or with an integrated movement. Integrated movement means that the beams 15 are interlocked to move outboard and inboard in opposite directions the same distance at the same rate. A drive unit 17 is mounted on the base frame to power the movement of the beams. The dotted representations in FIG. 2 show the towers moved inboard to positions on opposite sides of the gantry boom.

If the beams are interlocked for integrated movement, the weight of the towers 19 disposed at the ends of the beams counterbalance each other as the beams 15 are reciprocated in and out of the base frame 11. However, independent movement of the beams allows for a heavier work load disposed on one tower, when positioned at only partial extension of the beam, to be counterbalanced by extending the other beam and tower further out. The very light weight construction of the towers 15 allows for full extension of one beam and full retraction of the other if the towers are not occupied by more than one or two workmen/operators.

Figure 1:
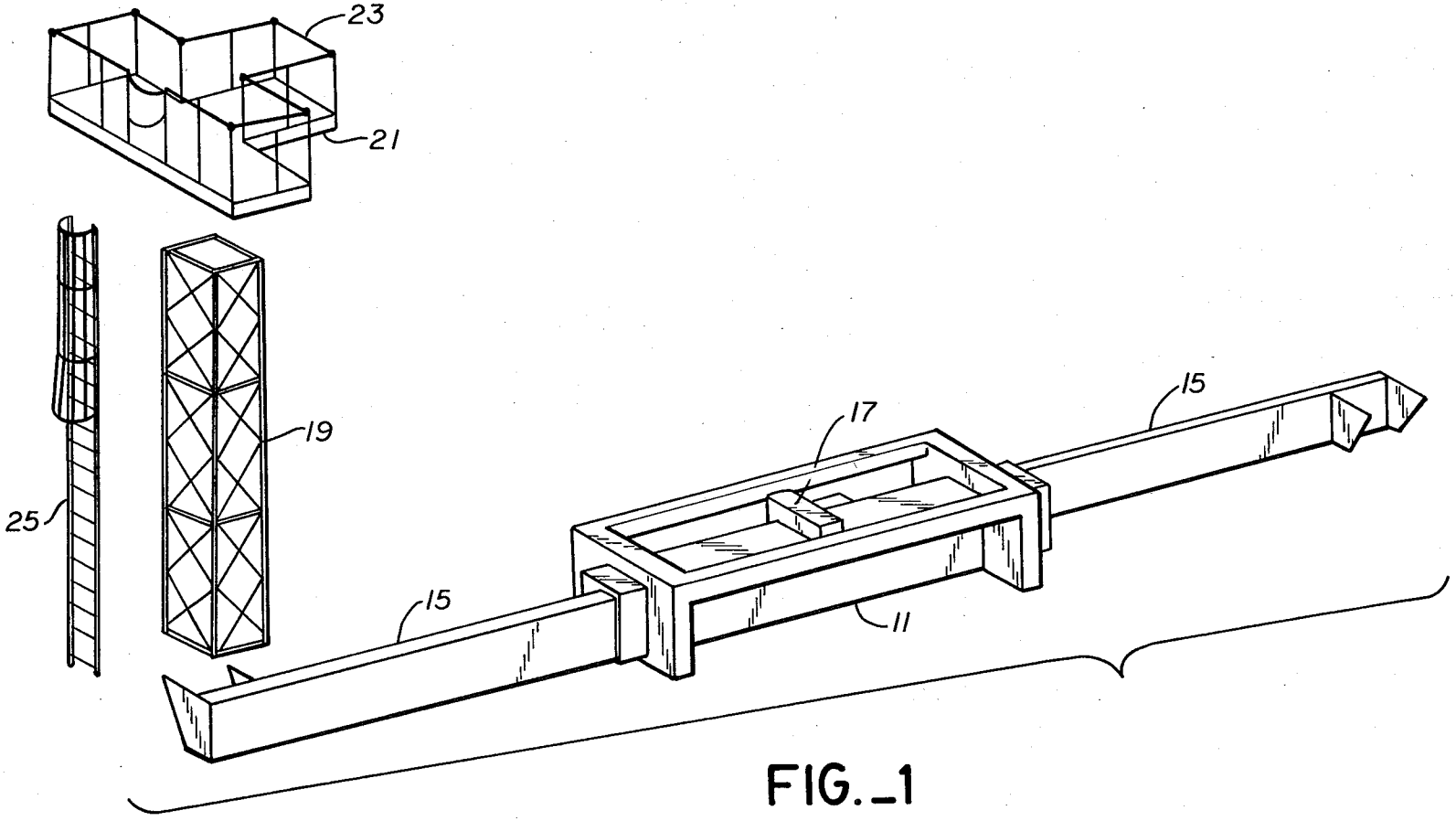
FIG. 1 is an exploded perspective view of the semi-adjustable service platform apparatus of the present invention.

The pair of towers 19 secured to the outboard ends of the sliding beams 15 are detachable as shown in exploded view of FIG. 1. The towers are secured to the beams with removable locking pins and can be made up of a multiplicity of sections which can also be pinned together with removable locking pins so that the height of the towers can be varied depending upon the number of tower sections that are utilized.

Work platforms 21 with detachable guard rails 23 are secured to the upper ends of the towers 19 with removable locking pins. Removable ladders 23 are secured to the towers to permit an operator/workman to climb from the reciprocating beam to the work platform.

Figure 5:
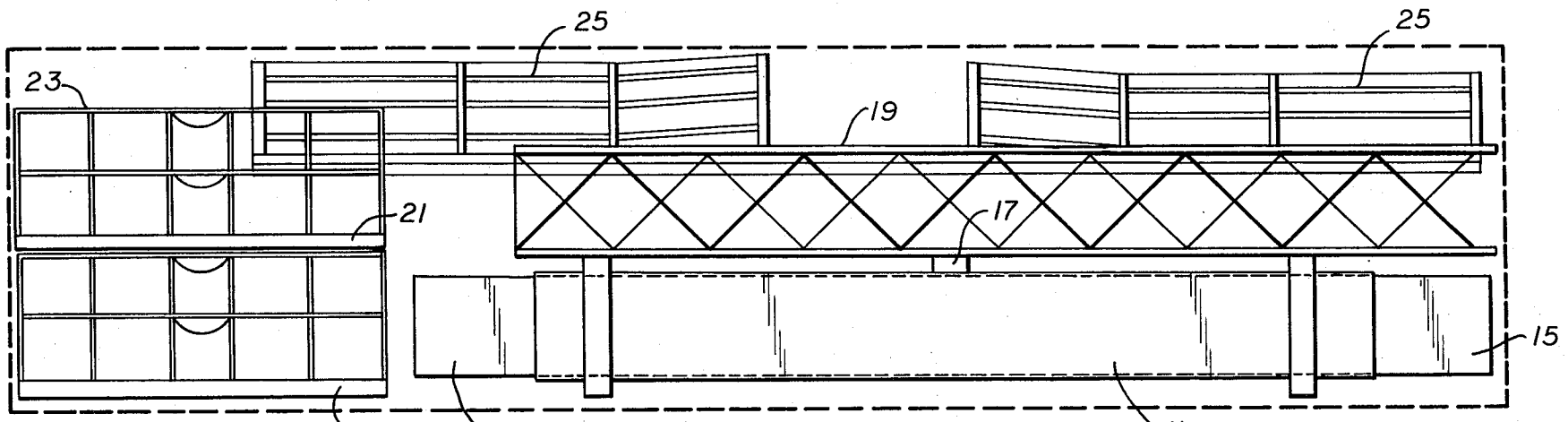
FIG. 5 is a side elevation of the present invention disassembled and arranged for deposition in a cargo container.
Figure 6:
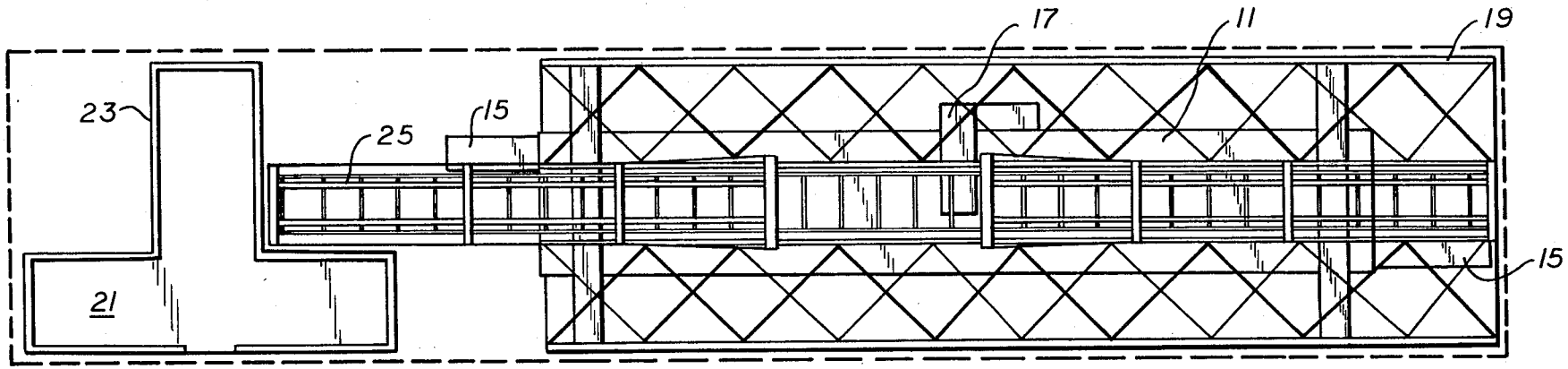
FIG. 6 is a top plan view of FIG. 5.

The towers 19 and the access ladders 25 are sized to stack or nest on top of the base frame 11 when detached from the sliding beams 15 and disassembled from the work platforms 21 as shown in FIGS. 5 and 6. The base frame with 25 foot long towers and access ladders disposed or nested thereon are sized to fit into a standard 40 foot container along with the two work platforms when the platforms are stacked on top of each other and disposed in one end of the container. The dotted lines in FIGS. 5 and 6 represent the interior dimensions of the container.

Remote controls are disposed on platform 21 for permitting an operator on a particular platform to control the either integrated or independent reciprocating movement of the sliding beams 11 and the position of the work platforms relative to the base frame. Movement of the service platform along the gantry and under the crane, the translational movement, is provided by the crane trolley. Height adjustment of the service platform is gained by the hoist motion of the crane. Therefore, controls for actuating the hoisting machinery on the trolley and movement of the trolley along the gantry are also provided on each platform. The controls at each work platform are interlocked to the crane controls to prevent the crane operator from inadvertently operating the crane in a way which would damage the service platform and to maintain a lower speed of trolley and hoist. Because of the vertical and dynamic instability factors inherent in suspending such a device, the operational speeds are limited to 10% of full operational speed of the crane. A more complete description of the safety features of the interlocked control system are also set forth in U.S. Pat. No. 4,546,852.

The present invention eliminates a large portion of the expensive machinery required for the apparatus disclosed in U.S. Pat. No. 4,546,852. The present device is of much simpler construction, making it therefore considerably lighter in weight and less expensive to manufacture, and while it is not as versatile with respect to the independent movements permitted by the prior art apparatus, the present invention utilizes the lift and hoist machinery inherent in the gantry crane wire rope reeving, and the movement of the trolley along the gantry to position the work platforms horizontally and vertically with respect to the A-frame supporting structure.

Thus, it will be seen from the description of the preferred embodiment of the present invention that all the objects and advantages attributable thereto have been obtained. While the invention has been described in considerable detail, the invention is not to be limited to such details as have been set forth except as may be necessitated by the appended claims.

What is claimed is:

1. A service platform apparatus for a gantry crane having a crane support structure, a horizontal boom structure and gantry, a trolley moveable on said boom and gantry, lifting ropes depending from said trolley and actuated by crane mounted hoist machinery, and a head block reeved to the lower ends of said lifting ropes, said service platform apparatus comprising a base frame adapted to be releasably secured to said head block, said base frame including a pair of horizontally sliding beams which are extendible in opposite directions from said base frame with either an integrated or independent movement, a pair of detachable towers secured to the ends of said sliding beams which project outboard from said base frame, said towers including detachable work platforms at the upper ends thereof, said towers being sized to stack on top of said base frame when disassembled and said base frame with the towers disposed thereon sized to fit into a standard 40′ container along with the two work platforms when the platforms are stacked on top of each other and disposed in one end of the same container, and remote control means on said platforms for permitting an operator on a particular platform to independently control the reciprocating movement of the sliding beams for moving the platforms inboard and outboard relative to the base frame and to control the hoisting and translational motions of the crane trolley.

2. The service platform apparatus of claim 1 in the detachable towers are comprised of a multiple of detachable sections whereby the height of the towers can be variably selected during assembly.

* * * * *